United States Patent [19]

Wheeler

[11] 4,029,115

[45] June 14, 1977

[54] PARTS WASHER

[75] Inventor: Edison L. Wheeler, Monticello, Ark.

[73] Assignees: Ted Wheeler; Elmer Lewis, both of Benton, Ark. ; part interest to each

[22] Filed: Sept. 3, 1975

[21] Appl. No.: 609,935

[52] U.S. Cl. ..... 134/111

[51] Int. Cl.[2] ..... B08B 3/00

[58] Field of Search ..... 222/265, 334, 335, 394, 222/399, 400.7, 400.8, 425, 449, 373, 377, 21, 22; 137/527.6; 134/111, 104

[56] References Cited

UNITED STATES PATENTS

| | | | |
|---|---|---|---|
| 201,758 | 3/1878 | Downey | 137/527.6 |
| 1,126,130 | 1/1915 | Torchiani | 222/373 |
| 2,438,654 | 3/1948 | Albertson | 134/111 |
| 2,520,398 | 8/1950 | Hanks | 222/373 |
| 2,675,012 | 4/1954 | Scales | 134/111 |
| 3,102,666 | 9/1963 | Fresard | 222/373 |
| 3,710,821 | 1/1973 | Turetsky et al. | 137/527.6 |

FOREIGN PATENTS OR APPLICATIONS

| | | | |
|---|---|---|---|
| 1,202,546 | 8/1970 | United Kingdom | 134/111 |

*Primary Examiner*—Robert B. Reeves
*Assistant Examiner*—H. Grant Skaggs
*Attorney, Agent, or Firm*—Clarence A. O'Brien; Harvey B. Jacobson

[57] ABSTRACT

Articles are washed in a receptacle by liquid solvent displaced by pressurized air from a pressure sealed container submerged with in a reservoir of said liquid solvent. A foot operated valve controls the supply of compressed air to the container. Release of the valve vents the container to effect refill with a metered quantity of solvent by opening of a pressure responsive gate valve.

1 Claim, 7 Drawing Figures

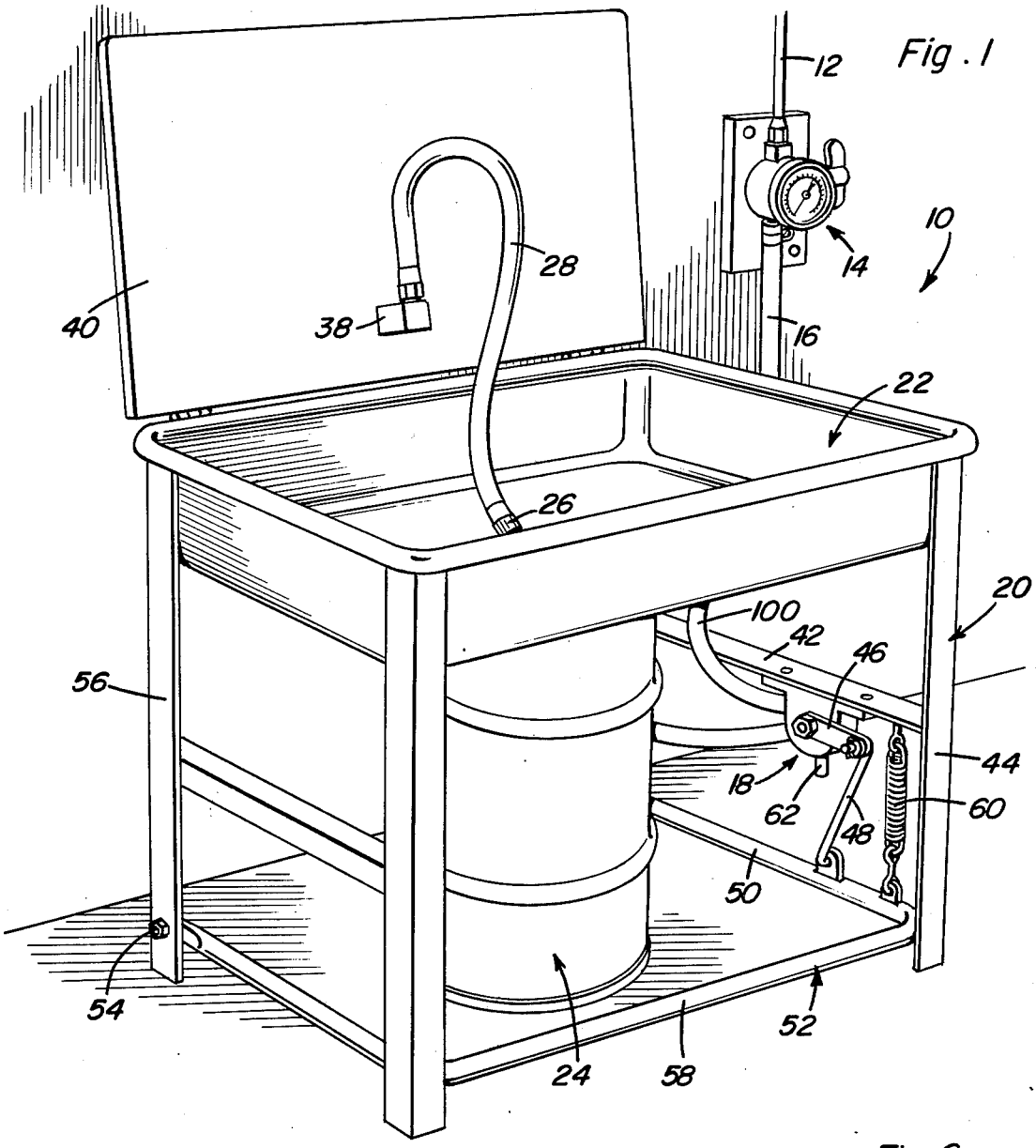
Fig. 1
Fig. 5
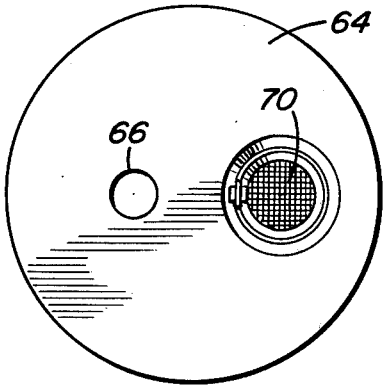
Fig. 6
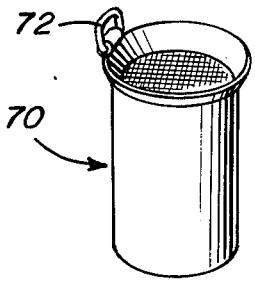

14
16
62
108
12
60
52
18
78
100
84
24
92
106
98
74
82
40
28
38
10
26
22
106
64
72
72
70
66
24
68
20
18
42
100
78
3
44
62
46
56
60
74
48
54
76
58
50
3

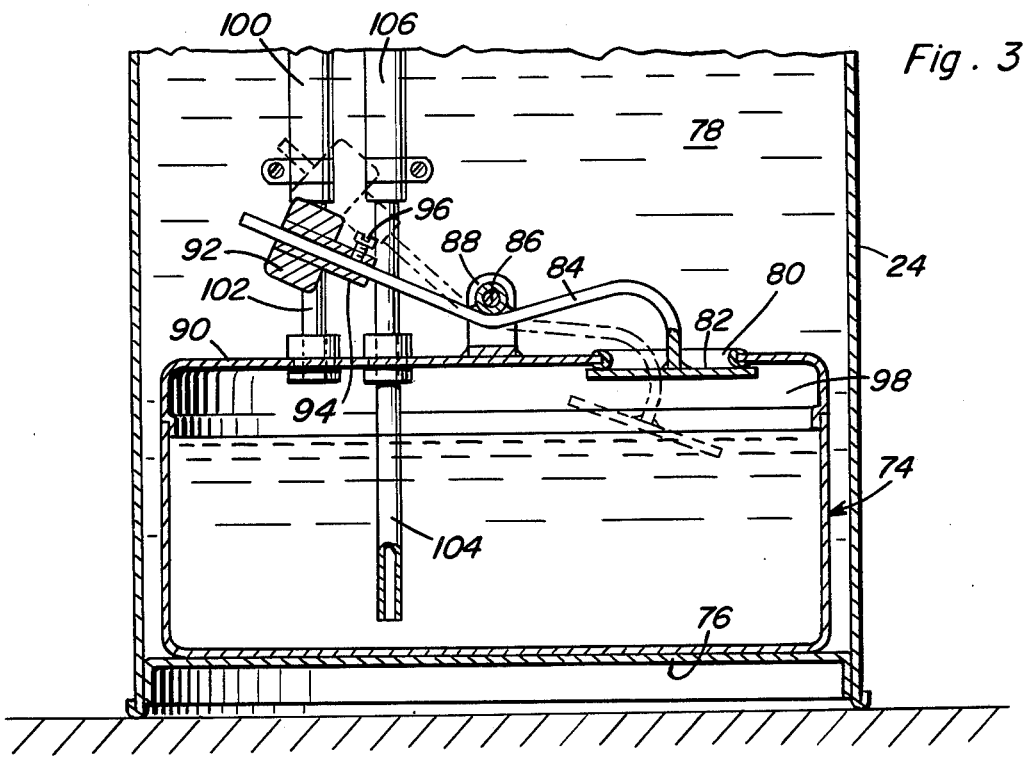
Fig. 3
Fig. 4
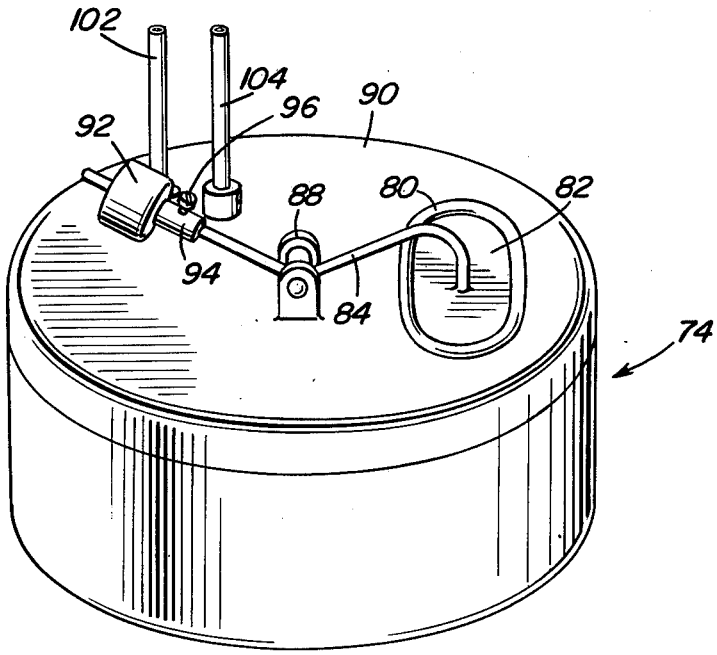

PARTS WASHER

This invention relates to apparatus for cleaning of relatively small solid articles such as tools and machine parts by use of a liquid solvent.

The cleaning of parts within a receptacle by use of a liquid solvent discharged into the receptacle through a dispensing nozzle, is well known as disclosed for example in U.S. Pat. Nos. 2,438,654, 2,897,830, 3,096,776, 3,378,019, and 3,416,544. Generally, such apparatus involves the use of pressurized air to induce flow of a liquid solvent from a reservoir into a dispensing tube from which the solvent is sprayed onto the parts through a nozzle, the liquid solvent draining back into the reservoir. The liquid solvent itself is either pressurized by a mechanically driven piston as disclosed in U.S. Pat. No. 2,438,654 to Albertson in order to displace it into the dispensing tube or is positively displaced by a motor operated pump as disclosed in U.S. Pat. Nos. 3,096,776 and 3,378,019 to DeWitt and Riolo et al, respectively. Also, flow of the liquid solvent is sometimes induced by the vacuum or suction pressure produced by the flow of air under pressure as disclosed for example in U.S. Pat. Nos. 2,897,830 and 3,416,544 to Palmer and Paiva. The latter prior art washing apparatus are relatively expensive to manufacture and operate, and subject to frequent malfunction because of the wear and corrosion of parts. It is therefore an important object of the present invention to provide a washing apparatus utilizing liquid solvent wherein the construction and operation of the apparatus is significantly less expensive as compared to prior art apparatus and which is less likely to malfunction and rapidly wear out.

In accordance with the present invention, the washing apparatus includes an article holding receptacle or basin into which liquid solvent is discharged through a nozzle from a dispensing conduit, the solvent draining from the receptacle through a filter into a reservoir within which a pressure sealed container is submerged containing a charge of the solvent. The dispensing conduit is connected to the pressure sealed container and conducts the liquid solvent therefrom under pressure in the discharge nozzle. The apparatus is connected to a source of pressurized gas such as compressed air through a foot operated valve assembly, through which the compressed air is supplied to the pressure sealed container in order to establish a pressurized air space therein and displace the liquid solvent into the dispensing conduit thereby inducing flow and discharge of the solvent from the nozzle. A gate valve is maintained closed by the air supplied to the container to seal the container while the solvent is being discharged. A counterweight associated with the gate valve also biases it to a closed position in opposition to the opening bias exerted by the weight of the body of liquid solvent within the reservoir. Upon release of the foot operated valve, the pressure sealed container is vented through the valve to thereby remove the gate valve closing bias of the air pressure within the pressure sealed container. The gate valve therefore opens to admit a metered quantity of liquid solvent into the container and then closes under the bias of the counterweight when the container is filled with a metered quantity of liquid solvent in preparation for subsequent discharge of liquid solvent from the container upon opening of the foot operated valve.

These together with other objects and advantages which will become subsequently apparent reside in the details of construction and operation as more fully hereinafter described and claimed, reference being had to the accompanying drawings forming a part hereof, wherein like numerals refer to like parts throughout.

FIG. 1 is a perspective view showing the apparatus of the present invention.

FIG. 3 is an enlarged partial sectional view taken substantially through a plane indicated by section line 3—3 in FIG. 2.

FIG. 4 is a perspective view of the pressure sealed, dispensing container associated with the apparatus.

FIG. 5 is a top plan view of the solvent reservoir associated with the apparatus.

FIG. 6 is a perspective view of the filter assembly suspended within the reservoir.

Figures 2, 7:
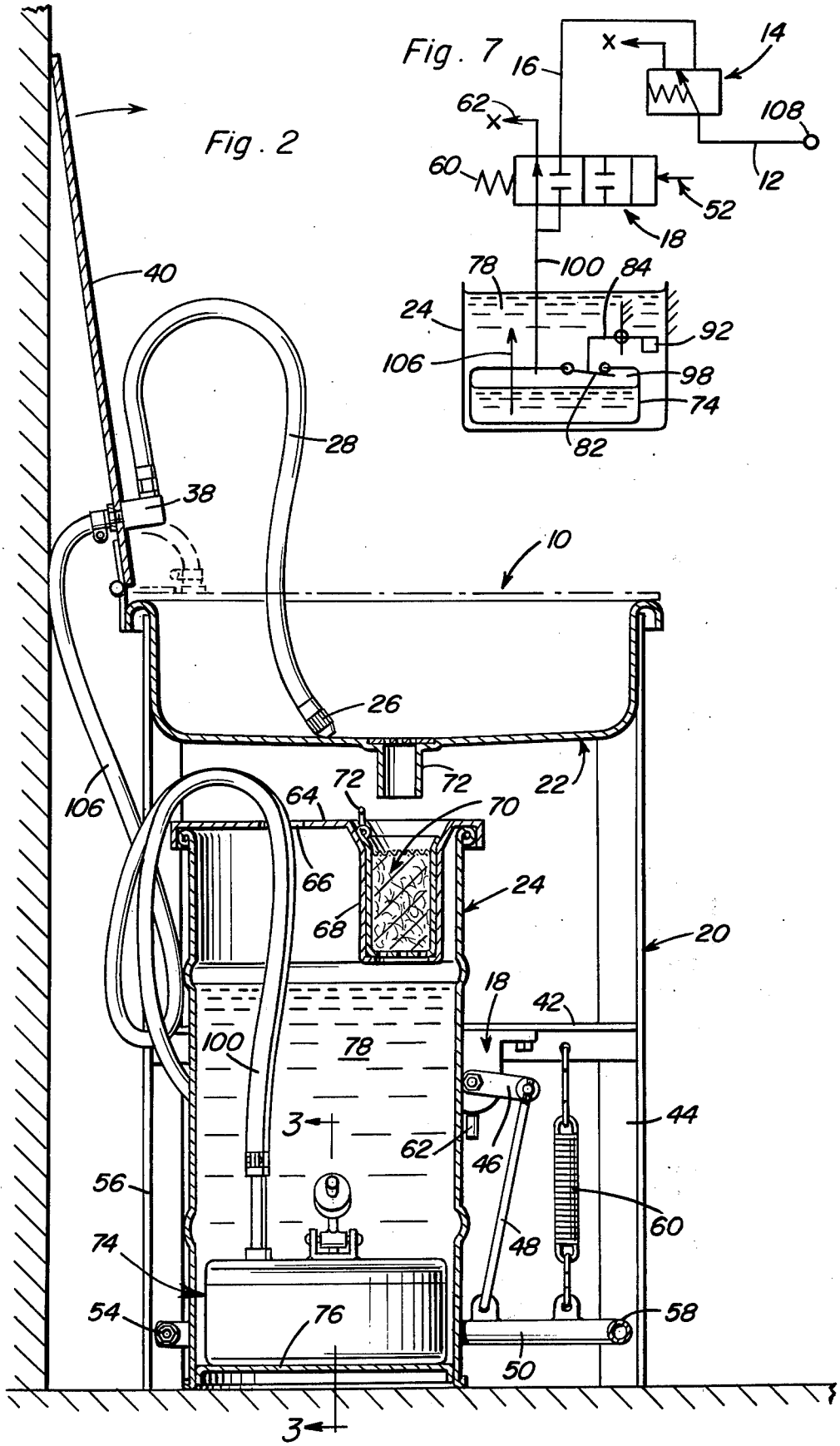
FIG. 2 is a side sectional view through the apparatus shown in FIG. 1.
FIG. 7 is a schematic fluid circuit diagram showing the control system associated with the apparatus of the present invention.

Referring now to the drawings in detail, FIG. 1 illustrates one embodiment of the apparatus of the present invention generally referred to by reference numeral 10. The apparatus is connected to a suitable source of pressurized gas such as a compressed air tank through a line pressure conduit 12. A pressure regulator 14 interconnects the line pressure conduit with a regulated pressure conduit 16 through which the pressurized gas is supplied to a selectively controlled valve assembly generally referred to by reference numeral 18. The valve assembly 18 is mounted at a suitable location on the base frame 20 horizontally supporting an article receptable or washbasin generally referred to by reference numeral 22. The washbasin or receptacle overlies a reservoir barrel or tank generally referred to by reference numeral 24 within which a body of liquid solvent is stored. The liquid solvent is discharged into the washbasin for cleaning articles such as tools and machine parts deposited therein, by means of a nozzle 26 connected to the discharge end of a dispensing tube 28 coupled to a fitting 30 fixedly mounted on a hinged cover 40 pivotally connected to the washbasin 22.

As shown in FIGS. 1 and 2, the casing of the valve assembly 18 is bolted to and depends from a cross frame member 42 of the base frame 20 and is thereby positioned on one side of the reservoir tank 24 disposed between the vertical legs 44 of the base frame to which the washbasin 22 is connected. A valve actuating lever arm 46 extends forwardly from the valve assembly and is connected by means of a link 48 to one of the parallel spaced lever legs 50 of a foot operated pedal or treadle 52. The legs 50 are pivotally connected by pivot bolt assemblies 54 to the rear legs 56 of the base frame and are interconnected at the front by a foot bar 58. A return spring 60 is interconnected between the cross frame member 42 and a leg 50 of the foot pedal 52 in order to normally hold the valve assembly 18 in one of its operative positions as shown in FIGS. 1 and 2. As shown, the valve assembly 18 is in a venting position in which fluid communication is established to atmosphere through an exhaust port 62 as will be explained hereafter.

Referring now to FIG. 2 in particular, the reservoir tank 24, which may be a 30 gallon barrel, is provided with a cover 64 having an opening 66 through which conduits may extend as will be hereafter explained.

Integral with the cover 64 and depending therefrom, is a cylindrical holder 68 into which a filter cartridge 70 is adapted to be seated in underlying relationship to a drain 72 depending from the washbasin or receptacle 22. It will be apparent therefore, that liquid solvent discharged into the washbasin 22 will drain back into the reservoir tank 24 through the filter cartridge 70 which may be readily removed for cleaning or replacement purposes by means of the lift ring 72 as more clearly seen in FIG. 6.

Referring now to FIGS. 2, 3 and 4, a solvent dispensing container generally referred to by reference numeral 74, is supported on the bottom wall 76 of the reservoir tank submerged within the body of liquid solvent 78. The dispensing container which may be a five gallon tank by way of example, encloses a pressure chamber adapted to be filled with a metered quantity of liquid solvent from the reservoir. An inlet opening peripherally lined with a sealing strip 80 admits the liquid solvent into the container 74 from the body of liquid 78 upon opening of a gate valve element 82 shown by solid line in its closed position in FIG. 3. A lever element 84 is connected to the gate valve element and pivotally mounted intermediate its ends by a pivot pin 86 removably assembled between spaced pivot brackets 88 fixed to the top 90 of the container 74. A counterweight 92 is slidably mounted on the arm of the lever element 84 on that side of the pivot pin 86 opposite the gate valve element 82 by means of a sleeve 94. The sleeve is releasably secured by means of a setscrew 96 to the lever element in an adjusted position of the counterweight in order to establish a gravitational bias tending to pivotally displace the lever element 84 in a counterclockwise direction as viewed in FIGS. 3 and 4 to thereby hold the gate valve element in the closed position. The gravitational bias of the counterweight 92 opposes the valve opening urge exerted on the gate valve element by the pressure of the liquid solvent in the reservoir tank 24 acting on the upper face of the gate valve element. When the interior of the container 74 is pressurized by supply of gas under pressure forming a gas pressure space 98 therein, the gas pressure will augment the gravitational bias of the counterweight in order to hold the gate valve element 82 closed. When the gas or air space 98 is vented however, the pressure of the body of liquid solvent 78 will overcome the gravitational bias of the counterweight 92 and displace the gate valve element to an open position as shown by dotted line in FIG. 3. Liquid solvent will thereby be admitted into the container 74 to refill the same. When refilled, the liquid solvent within the container 74 will effect closing of the gate valve element once again. The contaner 74 will then be firmly sealed when air under pressure is injected into the container to pressurize the liquid solvent therein and form the pressurized gas space 98 aforementioned.

Pressurized gas or compressed air is conducted into the container 74 upon opening of the selectively controlled valve assembly 18 by means of a flexible pressure supply conduit 100 connected to the top 90 of the container by means of the tube 102. A second tube 104 extends through the top 90 of the container terminating at a lower end adjacent the bottom of the container as more clearly seen in FIG. 3. The tube 104 is connected externally of the container to a flexible outlet conduit 106 that is connected by means of the fitting 38 on the pivoted cover 40 to the flexible dispensing hose 28. It will be apparent therefore, that when the liquid solvent within the container 74 is pressurized, it will be displaced from the container through the conduit 106 and hose 28 to the discharge nozzle 26.

FIG. 7 diagrammatically illustrates the controls associated with the apparatus 10 including the pressure regulator 14 through which air under pressure is conducted by the line 12 from the source of compressed air 108. Air at a regulated pressure is accordingly supplied through conduit 16 to the selectively controlled valve assembly 18 that is normally held in the venting position by spring 60 as shown in FIG. 7 with the air pressure supply conduit 100 connected to the exhaust port 62 thereby venting the gas or air space 98 within the container 74. When the space 98 is vented, the gate valve element 82 will open under the urge of the body of liquid 78 within the reservoir tank 24 to thereby effect refilling of the container 74 with the liquid solvent. When the container 74 is refilled sufficiently, the gate valve 82 closes under the gravitational bias of the counterweight 92. A metered quantity of liquid solvent will accordingly be available for subsequent cleaning purposes. The cleaning action is initiated by actuation of the pedal operator 52 opening the selectively controlled valve assembly 18. When the valve assembly 18 is actuated, the exhaust port 62 is blocked and the regulated air pressure is supplied to the conduit 100 resulting in the pressurization of the liquid within the container 74. The liquid solvent is accordingly displaced from the container 74 as an increasing gas space 98 is formed therein. The supply of compressed air not only induces outflow of the liquid solvent for discharge through the nozzle 26 into the washbasin or receptacle 22 but also maintains the gate valve 82 closed to seal the container 74 and maintain pressurization of the outflowing liquid solvent. When the foot pedal operator 52 is released, the return spring 60 restores the valve assembly 18 to its other operative position venting the air space 98 resulting in the opening of the gate valve 82. The gate valve 82 is held open under the urge of the liquid within the reservoir tank until the container 74 is refilled. Accordingly, by intermittent actuation of the selectively controlled valve assembly 18, a cleaning operation may be effected in an efficient manner by use of a minimum amount of air pressure.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A parts washer comprising a washbasin in the form of a shallow receptacle defined by a bottom wall and an upstanding peripheral wall, a base frame supporting said washbasin in elevated position above a support surface, a solvent dispensing tube having a discharge nozzle thereon supported on said washbasin to enable parts placed in the washbasin to be washed by directing the discharge nozzle toward the parts, a drain in the bottom of the washbasin to drain solvent and entrained material therefrom, a tank disposed below the washbasin and in vertical spaced relation to the bottom thereof, said tank including a quantity of liquid solvent and a cover having an inlet opening aligned with said drain, a generally cylindrical holder supported below the inlet opening, a filter cartridge positioned within the holder for filtering solvent passing therethrough by gravity flow, the lower end of the holder being open and the upper end flaring outwardly to form a funnel shaped guide for solvent discharged from the drain, said cartridge being disposed above the liquid level in the tank, means within said tank communicated with said tube and discharge nozzle for discharging pressurized solvent from the nozzle, and control means exteriorly of the tank for manually controlling operation of said solvent discharge means, said solvent discharge means including a container disposed in the bottom of said tank and including a top disposed below the level of liquid solvent in the tank, a solvent inlet opening in the container for gravity flow of solvent into the container, valve means closing said inlet opening, a discharge conduit extending from the bottom portion of the container to the solvent dispensing tube, and an air pressure line communicated with said container for pressurizing the container for pressure discharge of solvent and air through the discharge tube, said control means including an air valve in said air line selectively pressurizing and venting said container, said valve means in the container being automatically opened by the head of liquid solvent in the tank when the container is vented and at least partially empty and being closed when the container is filled and pressurized, said valve means including a plate disposed interiorly of the container, an upwardly extending and laterally extending lever attached to said plate, means pivotally supporting said lever from the exterior of the top of the container, a counterweight mounted on said lever on the opposite side of the pivot from the plate to normally retain the plate in closed position until the head of liquid solvent in the tank above the plate is greater than the combined force exerted by the counterweight and any pressure in the container, said air valve including a foot-operated pedal positioned adjacent the front lower end of the base frame for access by a person manipulating parts and nozzle in the washbasin.

* * * * *